US010422078B2

(12) United States Patent
Sealey et al.

(10) Patent No.: US 10,422,078 B2
(45) Date of Patent: Sep. 24, 2019

(54) FORMER OF WATER LAID ASSET THAT UTILIZES A STRUCTURED FABRIC AS THE OUTER WIRE

(71) Applicant: STRUCTURED I, LLC, Great Neck, NY (US)

(72) Inventors: James E. Sealey, Belton, SC (US); Bryd Tyler Miller, IV, Easley, SC (US)

(73) Assignee: STRUCTURED I, LLC, Great Neck, NY (US)

( * ) Notice: Subject to any disclaimer, the term of this patent is extended or adjusted under 35 U.S.C. 154(b) by 179 days.

(21) Appl. No.: 15/702,291

(22) Filed: Sep. 12, 2017

(65) Prior Publication Data

US 2018/0073195 A1 Mar. 15, 2018

Related U.S. Application Data

(60) Provisional application No. 62/393,468, filed on Sep. 12, 2016.

(51) Int. Cl.

| | |
|---|---|
| ***D21F 1/00*** | (2006.01) |
| ***D21F 5/14*** | (2006.01) |
| ***D21F 5/18*** | (2006.01) |
| ***D21F 5/00*** | (2006.01) |
| ***D21G 1/00*** | (2006.01) |
| ***D21F 3/08*** | (2006.01) |

(Continued)

(52) U.S. Cl.

CPC ..... *D21F 1/0036* (2013.01); *D21F 1/0027* (2013.01); *D21F 3/08* (2013.01); *D21F 5/004* (2013.01); *D21F 5/14* (2013.01); *D21F 5/182* (2013.01); *D21F 9/006* (2013.01); *D21F 11/006* (2013.01); *D21F 11/14* (2013.01); *D21G 1/00* (2013.01)

(58) Field of Classification Search

USPC ..... 162/111, 16, 123

See application file for complete search history.

(56) References Cited

U.S. PATENT DOCUMENTS

| | | | |
|---|---|---|---|
| 2,919,467 | A | 1/1960 | Mercer |
| 2,926,154 | A | 2/1960 | Keim |

(Continued)

FOREIGN PATENT DOCUMENTS

| | | | |
|---|---|---|---|
| CA | 2168894 | A1 | 8/1997 |
| CA | 2795139 | A1 | 10/2011 |

(Continued)

OTHER PUBLICATIONS

International Preliminary Report on Patentability of PCT/US2013/053593 dated Feb. 3, 2015.

(Continued)

*Primary Examiner* — Dennis R Cordray

(74) *Attorney, Agent, or Firm* — Amster, Rothstein & Ebenstein LLP

(57) ABSTRACT

A method of forming a fibrous web including the steps of providing a fiber slurry, depositing the fiber slurry between an inner forming wire and an outer forming wire, wherein the outer forming wire comprises a structured fabric and the inner forming wire contacts a segment of a forming roll, and rotating the forming roll so that the fiber slurry moves into contact with the structured fabric.

17 Claims, 2 Drawing Sheets

(51) Int. Cl.

| | |
|---|---|
| ***D21F 9/00*** | (2006.01) |
| ***D21F 11/00*** | (2006.01) |
| ***D21F 11/14*** | (2006.01) |

(56) References Cited

U.S. PATENT DOCUMENTS

| | | | |
|---|---|---|---|
| 3,026,231 | A | 3/1962 | Chavannes |
| 3,049,469 | A | 8/1962 | Davison |
| 3,058,873 | A | 10/1962 | Keim et al. |
| 3,066,066 | A | 11/1962 | Keim et al. |
| 3,097,994 | A | 7/1963 | Dickens et al. |
| 3,125,552 | A | 3/1964 | Loshaek et al. |
| 3,143,150 | A | 8/1964 | Buchanan |
| 3,186,900 | A | 6/1965 | De Young |
| 3,197,427 | A | 7/1965 | Schmalz |
| 3,224,986 | A | 12/1965 | Butler et al. |
| 3,224,990 | A | 12/1965 | Babcock |
| 3,227,615 | A | 1/1966 | Korden |
| 3,227,671 | A | 1/1966 | Keim |
| 3,239,491 | A | 3/1966 | Tsou et al. |
| 3,240,664 | A | 3/1966 | Earle, Jr. |
| 3,240,761 | A | 3/1966 | Keim et al. |
| 3,248,280 | A | 4/1966 | Hyland, Jr. |
| 3,250,664 | A | 5/1966 | Conte et al. |
| 3,252,181 | A | 5/1966 | Hureau |
| 3,301,746 | A | 1/1967 | Sanford et al. |
| 3,311,594 | A | 3/1967 | Earle, Jr. |
| 3,329,657 | A | 7/1967 | Strazdins et al. |
| 3,332,834 | A | 7/1967 | Reynolds, Jr. |
| 3,332,901 | A | 7/1967 | Keim |
| 3,352,833 | A | 11/1967 | Earle, Jr. |
| 3,384,692 | A | 5/1968 | Galt et al. |
| 3,414,459 | A | 12/1968 | Wells |
| 3,442,754 | A | 5/1969 | Espy |
| 3,459,697 | A | 8/1969 | Goldberg et al. |
| 3,473,576 | A | 10/1969 | Amneus |
| 3,483,077 | A | 12/1969 | Aldrich |
| 3,545,165 | A | 12/1970 | Greenwell |
| 3,556,932 | A | 1/1971 | Coscia et al. |
| 3,573,164 | A | 3/1971 | Friedberg et al. |
| 3,609,126 | A | 9/1971 | Asao et al. |
| 3,666,609 | A | 5/1972 | Kalwaites et al. |
| 3,672,949 | A | 6/1972 | Brown |
| 3,672,950 | A | 6/1972 | Murphy et al. |
| 3,773,290 | A | 11/1973 | Mowery |
| 3,778,339 | A | 12/1973 | Williams et al. |
| 3,813,362 | A | 5/1974 | Coscia et al. |
| 3,855,158 | A | 12/1974 | Petrovich et al. |
| 3,877,510 | A | 4/1975 | Tegtmeier et al. |
| 3,905,863 | A | 9/1975 | Ayers |
| 3,911,173 | A | 10/1975 | Sprague, Jr. |
| 3,974,025 | A | 8/1976 | Ayers |
| 3,994,771 | A | 11/1976 | Morgan, Jr. et al. |
| 3,998,690 | A | 12/1976 | Lyness et al. |
| 4,038,008 | A | 7/1977 | Larsen |
| 4,075,382 | A | 2/1978 | Chapman et al. |
| 4,088,528 | A | 5/1978 | Berger et al. |
| 4,098,632 | A | 7/1978 | Sprague, Jr. |
| 4,102,737 | A | 7/1978 | Morton |
| 4,129,528 | A | 12/1978 | Petrovich et al. |
| 4,147,586 | A | 4/1979 | Petrovich et al. |
| 4,184,519 | A | 1/1980 | McDonald et al. |
| 4,190,692 | A | 2/1980 | Larsen |
| 4,191,609 | A | 3/1980 | Trokhan |
| 4,252,761 | A | 2/1981 | Schoggen et al. |
| 4,320,162 | A | 3/1982 | Schulz |
| 4,331,510 | A | 5/1982 | Wells |
| 4,382,987 | A | 5/1983 | Smart |
| 4,440,597 | A | 4/1984 | Wells et al. |
| 4,501,862 | A | 2/1985 | Keim |
| 4,507,351 | A | 3/1985 | Johnson et al. |
| 4,514,345 | A | 4/1985 | Johnson et al. |
| 4,515,657 | A | 5/1985 | Maslanka |
| 4,528,239 | A | 7/1985 | Trokhan |
| 4,529,480 | A | 7/1985 | Trokhan |
| 4,537,657 | A | 8/1985 | Keim |
| 4,545,857 | A | 10/1985 | Wells |
| 4,637,859 | A | 1/1987 | Trokhan |
| 4,678,590 | A | 7/1987 | Nakamura et al. |
| 4,714,736 | A | 12/1987 | Juhl et al. |
| 4,770,920 | A | 9/1988 | Larsonneur |
| 4,780,357 | A | 10/1988 | Akao |
| 4,808,467 | A | 2/1989 | Suskind et al. |
| 4,836,894 | A | 6/1989 | Chance et al. |
| 4,849,054 | A | 7/1989 | Klowak |
| 4,885,202 | A | 12/1989 | Lloyd et al. |
| 4,891,249 | A | 1/1990 | McIntyre |
| 4,909,284 | A | 3/1990 | Kositake |
| 4,949,668 | A | 8/1990 | Heindel et al. |
| 4,949,688 | A | 8/1990 | Bayless |
| 4,983,256 | A | 1/1991 | Combette et al. |
| 4,996,091 | A | 2/1991 | McIntyre |
| 5,059,282 | A | 10/1991 | Ampulski et al. |
| 5,143,776 | A | 9/1992 | Givens |
| 5,149,401 | A | 9/1992 | Langevin et al. |
| 5,152,874 | A | 10/1992 | Keller |
| 5,211,813 | A | 5/1993 | Sawley et al. |
| 5,239,047 | A | 8/1993 | Devore et al. |
| 5,279,098 | A | 1/1994 | Fukuda |
| 5,281,306 | A | 1/1994 | Kakiuchi et al. |
| 5,334,289 | A | 8/1994 | Trokhan et al. |
| 5,347,795 | A | 9/1994 | Fukuda |
| 5,397,435 | A | 3/1995 | Ostendorf et al. |
| 5,399,412 | A | 3/1995 | Sudall et al. |
| 5,405,501 | A | 4/1995 | Phan et al. |
| 5,409,572 | A | 4/1995 | Kershaw et al. |
| 5,429,686 | A | 7/1995 | Chiu et al. |
| 5,439,559 | A | 8/1995 | Crouse |
| 5,447,012 | A | 9/1995 | Kovacs et al. |
| 5,470,436 | A | 11/1995 | Wagle et al. |
| 5,487,313 | A | 1/1996 | Johnson |
| 5,509,913 | A | 4/1996 | Yeo |
| 5,510,002 | A | 4/1996 | Hermans et al. |
| 5,529,665 | A | 6/1996 | Kaun |
| 5,581,906 | A | 12/1996 | Ensign et al. |
| 5,591,147 | A | 1/1997 | Couture-Dorschner et al. |
| 5,607,551 | A | 3/1997 | Farrington, Jr. et al. |
| 5,611,890 | A | 3/1997 | Vinson et al. |
| 5,628,876 | A | 5/1997 | Ayers et al. |
| 5,635,028 | A | 6/1997 | Vinson et al. |
| 5,649,916 | A | 7/1997 | Dipalma et al. |
| 5,671,897 | A | 9/1997 | Ogg et al. |
| 5,672,248 | A | 9/1997 | Wendt et al. |
| 5,679,222 | A | 10/1997 | Rasch et al. |
| 5,685,428 | A | 11/1997 | Herbers et al. |
| 5,728,268 | A | 3/1998 | Weisman et al. |
| 5,746,887 | A | 5/1998 | Wendt et al. |
| 5,753,067 | A | 5/1998 | Fukuda et al. |
| 5,772,845 | A | 6/1998 | Farrington, Jr. et al. |
| 5,806,569 | A | 9/1998 | Gulya et al. |
| 5,827,384 | A | 10/1998 | Canfield et al. |
| 5,832,962 | A | 11/1998 | Kaufman et al. |
| 5,846,380 | A | 12/1998 | Van Phan et al. |
| 5,855,738 | A | 1/1999 | Weisman et al. |
| 5,858,554 | A | 1/1999 | Neal et al. |
| 5,865,396 | A | 2/1999 | Ogg et al. |
| 5,865,950 | A | 2/1999 | Vinson et al. |
| 5,893,965 | A | 4/1999 | Trokhan et al. |
| 5,913,765 | A | 6/1999 | Burgess et al. |
| 5,942,085 | A | 8/1999 | Neal et al. |
| 5,944,954 | A | 8/1999 | Vinson et al. |
| 5,948,210 | A | 9/1999 | Huston |
| 5,980,691 | A | 11/1999 | Weisman et al. |
| 6,036,139 | A | 3/2000 | Ogg |
| 6,039,838 | A | 3/2000 | Kaufman et al. |
| 6,048,938 | A | 4/2000 | Neal et al. |
| 6,060,149 | A | 5/2000 | Nissing et al. |
| 6,106,670 | A | 8/2000 | Weisman et al. |
| 6,149,769 | A | 11/2000 | Mohammadi et al. |
| 6,162,327 | A | 12/2000 | Batra et al. |
| 6,162,329 | A | 12/2000 | Vinson et al. |
| 6,187,138 | B1 | 2/2001 | Neal et al. |
| 6,200,419 | B1 | 3/2001 | Phan |
| 6,203,667 | B1 | 3/2001 | Huhtelin |

(56) References Cited

U.S. PATENT DOCUMENTS 6,207,734 B1 3/2001 Vinson et al.
6,231,723 B1 5/2001 Kanitz et al.
6,287,426 B1 9/2001 Edwards et al.
6,303,233 B1 10/2001 Amon et al.
6,319,362 B1 11/2001 Huhtelin et al.
6,344,111 B1 2/2002 Wilhelm
6,420,013 B1 7/2002 Vinson et al.
6,420,100 B1 7/2002 Trokhan et al.
6,423,184 B2 7/2002 Vahatalo et al.
6,458,246 B1 10/2002 Kanitz et al.
6,464,831 B1 10/2002 Trokhan et al.
6,473,670 B1 10/2002 Huhtelin
6,521,089 B1 2/2003 Griech et al.
6,537,407 B1 3/2003 Law et al.
6,547,928 B2 4/2003 Bamholtz et al.
6,551,453 B2 4/2003 Weisman et al.
6,551,691 B1 4/2003 Hoeft et al.
6,572,722 B1 6/2003 Pratt
6,579,416 B1 6/2003 Vinson et al.
6,602,454 B2 8/2003 McGuire et al.
6,607,637 B1 8/2003 Vinson et al.
6,610,173 B1 8/2003 Lindsay et al.
6,613,194 B2 9/2003 Kanitz et al.
6,660,362 B1 12/2003 Lindsay et al.
6,673,202 B2 1/2004 Burazin
6,701,637 B2 3/2004 Lindsay et al.
6,755,939 B2 6/2004 Vinson et al.
6,773,647 B2 8/2004 McGuire et al.
6,797,117 B1 9/2004 McKay et al.
6,808,599 B2 10/2004 Burazin
6,821,386 B2 11/2004 Weisman et al.
6,821,391 B2 11/2004 Scherb et al.
6,827,818 B2 12/2004 Farrington, Jr. et al.
6,863,777 B2 3/2005 Kanitz et al.
6,896,767 B2 5/2005 Wilhelm
6,939,443 B2 9/2005 Ryan et al.
6,998,017 B2 2/2006 Lindsay et al.
6,998,024 B2 2/2006 Burazin
7,005,043 B2 2/2006 Toney et al.
7,014,735 B2 3/2006 Kramer et al.
7,105,465 B2 9/2006 Patel et al.
7,155,876 B2 1/2007 VanderTuin et al.
7,157,389 B2 1/2007 Branham et al.
7,182,837 B2 2/2007 Chen et al.
7,194,788 B2 3/2007 Clark et al.
7,235,156 B2 6/2007 Baggot
7,269,929 B2 9/2007 VanderTuin et al.
7,294,230 B2 11/2007 Flugge-Berendes et al.
7,311,853 B2 12/2007 Vinson et al.
7,328,550 B2 2/2008 Floding et al.
7,339,378 B2 3/2008 Han et al.
7,351,307 B2 4/2008 Scherb et al.
7,387,706 B2 6/2008 Herman et al.
7,399,378 B2 7/2008 Edwards et al.
7,419,569 B2 9/2008 Hermans
7,427,434 B2 9/2008 Busam
7,431,801 B2 10/2008 Conn et al.
7,432,309 B2 10/2008 Vinson
7,442,278 B2 10/2008 Murray et al.
7,452,447 B2 11/2008 Duan et al.
7,476,293 B2 1/2009 Herman et al.
7,494,563 B2 2/2009 Edwards et al.
7,510,631 B2 3/2009 Scherb et al.
7,513,975 B2 4/2009 Burma
7,563,344 B2 7/2009 Beuther
7,582,187 B2 9/2009 Scherb et al.
7,611,607 B2 11/2009 Mullally et al.
7,622,020 B2 11/2009 Awofeso
7,662,462 B2 2/2010 Noda
7,670,678 B2 3/2010 Phan
7,683,126 B2 3/2010 Neal et al.
7,686,923 B2 3/2010 Scherb et al.
7,687,140 B2 3/2010 Manifold et al.
7,691,230 B2 4/2010 Scherb et al.
7,744,722 B1 6/2010 Tucker et al.
7,744,726 B2 6/2010 Scherb et al.
7,785,443 B2 * 8/2010 Hermans ..... D21H 27/002 162/168.1
7,799,382 B2 9/2010 Payne et al.
7,811,418 B2 10/2010 Klerelid et al.
7,815,978 B2 10/2010 Davenport et al.
7,823,366 B2 11/2010 Schoeneck
7,842,163 B2 11/2010 Nickel et al.
7,867,361 B2 1/2011 Salaam et al.
7,871,692 B2 1/2011 Morin et al.
7,887,673 B2 2/2011 Andersson et al.
7,905,989 B2 3/2011 Scherb et al.
7,914,866 B2 3/2011 Shannon et al.
7,931,781 B2 4/2011 Scherb et al.
7,951,269 B2 5/2011 Herman et al.
7,955,549 B2 6/2011 Noda
7,959,764 B2 6/2011 Ringer et al.
7,972,475 B2 7/2011 Chan et al.
7,989,058 B2 8/2011 Manifold et al.
8,034,463 B2 10/2011 Leimbach et al.
3,051,629 A1 11/2011 Pazdemik et al.
8,075,739 B2 12/2011 Scherb et al.
8,092,652 B2 1/2012 Scherb et al.
8,118,979 B2 2/2012 Herman et al.
8,147,649 B1 4/2012 Tucker et al.
8,152,959 B2 4/2012 Elony et al.
8,196,314 B2 6/2012 Munch
8,216,427 B2 7/2012 Klerelid et al.
8,236,135 B2 8/2012 Prodoehl et al.
8,303,773 B2 11/2012 Scherb et al.
8,382,956 B2 2/2013 Boechat et al.
8,402,673 B2 3/2013 Da Silva et al.
8,409,404 B2 4/2013 Harper et al.
8,435,384 B2 5/2013 Da Silva et al.
8,440,055 B2 5/2013 Scherb et al.
8,445,032 B2 5/2013 Topolkaraev et al.
8,454,800 B2 6/2013 Mourad et al.
8,470,133 B2 6/2013 Cunnane et al.
8,506,756 B2 8/2013 Denis et al.
8,544,184 B2 10/2013 Da Silva et al.
8,574,211 B2 11/2013 Morita
8,580,083 B2 11/2013 Boechat et al.
8,728,277 B2 5/2014 Boechat et al.
8,758,569 B2 6/2014 Aberg et al.
8,771,466 B2 7/2014 Denis et al.
8,801,903 B2 8/2014 Mourad et al.
8,815,057 B2 8/2014 Eberhardt et al.
8,822,009 B2 9/2014 Riviere et al.
8,968,517 B2 3/2015 Ramaratnam et al.
8,980,062 B2 3/2015 Karlsson et al.
9,005,710 B2 4/2015 Jones et al.
D734,617 S 7/2015 Seitzinger et al.
9,095,477 B2 8/2015 Yamaguchi
D738,633 S 9/2015 Seitzinger et al.
9,382,666 B2 7/2016 Ramaratnam et al.
9,506,203 B2 11/2016 Ramaratnam et al.
9,580,872 B2 2/2017 Ramaratnam et al.
9,702,089 B2 7/2017 Ramaratnam et al.
9,702,090 B2 7/2017 Ramaratnam et al.
9,719,213 B2 8/2017 Miller, IV et al.
9,725,853 B2 8/2017 Ramaratnam et al.
2001/0018068 A1 8/2001 Lorenzi et al.
2002/0028230 A1 3/2002 Eichhorn et al.
2002/0060049 A1 5/2002 Kanitz et al.
2002/0061386 A1 5/2002 Carson et al.
2002/0098317 A1 7/2002 Jaschinski et al.
2002/0110655 A1 8/2002 Seth
2002/0115194 A1 8/2002 Lange et al.
2002/0117283 A1 8/2002 Soderholm et al.
2002/0125606 A1 9/2002 McGuire et al.
2003/0024674 A1 2/2003 Kanitz et al.
2003/0056911 A1 3/2003 Hermans et al.
2003/0056917 A1 3/2003 Jimenez
2003/0070781 A1 4/2003 Hermans et al.
2003/0114071 A1 6/2003 Everhart et al.
2003/0159401 A1 8/2003 Sorensson et al.
2003/0188843 A1 10/2003 Kanitz et al.
2003/0218274 A1 11/2003 Boutilier et al.
2004/0118531 A1 6/2004 Shannon et al.

(56) References Cited

U.S. PATENT DOCUMENTS

| | | | |
|---|---|---|---|
| 2004/0123963 | A1 | 7/2004 | Chen et al. |
| 2004/0126601 | A1 | 7/2004 | Kramer et al. |
| 2004/0126710 | A1 | 7/2004 | Hill et al. |
| 2004/0168784 | A1 | 9/2004 | Duan et al. |
| 2004/0173333 | A1 | 9/2004 | Hermans et al. |
| 2004/0234804 | A1 | 11/2004 | Liu et al. |
| 2005/0016704 | A1 | 1/2005 | Huhtelin |
| 2005/0069679 | A1 | 3/2005 | Stelljes et al. |
| 2005/0069680 | A1 | 3/2005 | Stelljes et al. |
| 2005/0098281 | A1 | 5/2005 | Schulz et al. |
| 2005/0112115 | A1 | 5/2005 | Khan |
| 2005/0123726 | A1 | 6/2005 | Broering et al. |
| 2005/0130536 | A1 | 6/2005 | Siebers et al. |
| 2005/0136222 | A1 | 6/2005 | Hada et al. |
| 2005/0148257 | A1 | 7/2005 | Hermans et al. |
| 2005/0150626 | A1 | 7/2005 | Kanitz et al. |
| 2005/0166551 | A1 | 8/2005 | Keane et al. |
| 2005/0241786 | A1 | 11/2005 | Edwards et al. |
| 2005/0241788 | A1 | 11/2005 | Baggot et al. |
| 2005/0252626 | A1 | 11/2005 | Chen et al. |
| 2005/0280184 | A1 | 12/2005 | Sayers et al. |
| 2005/0287340 | A1 | 12/2005 | Morelli et al. |
| 2006/0005916 | A1 | 1/2006 | Stelljes et al. |
| 2006/0013998 | A1 | 1/2006 | Stelljes et al. |
| 2006/0019567 | A1 | 1/2006 | Sayers |
| 2006/0083899 | A1 | 4/2006 | Burazin et al. |
| 2006/0093788 | A1 | 5/2006 | Behm et al. |
| 2006/0113049 | A1 | 6/2006 | Knobloch et al. |
| 2006/0130986 | A1 | 6/2006 | Flugge-Berendes et al. |
| 2006/0194022 | A1 | 8/2006 | Boutilier et al. |
| 2006/0269706 | A1 | 11/2006 | Shannon et al. |
| 2007/0020315 | A1 | 1/2007 | Shannon et al. |
| 2007/0107863 | A1 | 5/2007 | Edwards et al. |
| 2007/0131366 | A1 | 6/2007 | Underhill et al. |
| 2007/0137813 | A1 | 6/2007 | Nickel et al. |
| 2007/0137814 | A1 | 6/2007 | Gao |
| 2007/0170610 | A1 | 7/2007 | Payne et al. |
| 2007/0240842 | A1 | 10/2007 | Scherb et al. |
| 2007/0251659 | A1 | 11/2007 | Fernandes et al. |
| 2007/0251660 | A1 | 11/2007 | Walkenhaus et al. |
| 2007/0267157 | A1 | 11/2007 | Kanitz et al. |
| 2007/0272381 | A1 | 11/2007 | Elony et al. |
| 2007/0275866 | A1 | 11/2007 | Dykstra |
| 2007/0298221 | A1 | 12/2007 | Vinson |
| 2008/0035289 | A1 | 2/2008 | Edwards et al. |
| 2008/0076695 | A1 | 3/2008 | Uitenbroek et al. |
| 2008/0156450 | A1 | 7/2008 | Klerelid et al. |
| 2008/0199655 | A1 | 8/2008 | Monnerie et al. |
| 2008/0245498 | A1 | 10/2008 | Ostendorf et al. |
| 2008/0302493 | A1 | 12/2008 | Boatman et al. |
| 2008/0308247 | A1 | 12/2008 | Ringer et al. |
| 2009/0020248 | A1 | 1/2009 | Sumnicht et al. |
| 2009/0056892 | A1 | 3/2009 | Rekoske |
| 2009/0061709 | A1 | 3/2009 | Nakai et al. |
| 2009/0205797 | A1 | 8/2009 | Fernandes et al. |
| 2009/0218056 | A1 | 9/2009 | Manifold et al. |
| 2010/0065234 | A1 | 3/2010 | Klerelid et al. |
| 2010/0119779 | A1 | 5/2010 | Ostendorf et al. |
| 2010/0224338 | A1 | 9/2010 | Harper et al. |
| 2010/0230064 | A1 | 9/2010 | Eagles et al. |
| 2010/0236034 | A1 | 9/2010 | Eagles et al. |
| 2010/0239825 | A1 | 9/2010 | Sheehan et al. |
| 2010/0272965 | A1 | 10/2010 | Schinkoreit et al. |
| 2011/0027545 | A1 | 2/2011 | Harlacher et al. |
| 2011/0180223 | A1 | 7/2011 | Klerelid et al. |
| 2011/0189435 | A1 | 8/2011 | Manifold et al. |
| 2011/0189442 | A1 | 8/2011 | Manifold et al. |
| 2011/0206913 | A1 | 8/2011 | Manifold et al. |
| 2011/0223381 | A1 | 9/2011 | Sauter et al. |
| 2011/0253329 | A1 | 10/2011 | Manifold et al. |
| 2011/0265967 | A1 | 11/2011 | Van Phan |
| 2011/0303379 | A1 | 12/2011 | Boechat et al. |
| 2012/0144611 | A1 | 6/2012 | Baker et al. |
| 2012/0152475 | A1 | 6/2012 | Edwards et al. |
| 2012/0177888 | A1 | 7/2012 | Escafere et al. |
| 2012/0244241 | A1 | 9/2012 | McNeil |
| 2012/0267063 | A1 | 10/2012 | Klerelid et al. |
| 2012/0297560 | A1 | 11/2012 | Zwick et al. |
| 2013/0008135 | A1 | 1/2013 | Moore et al. |
| 2013/0029105 | A1 | 1/2013 | Miller et al. |
| 2013/0029106 | A1 | 1/2013 | Lee et al. |
| 2013/0133851 | A1 | 5/2013 | Boechat et al. |
| 2013/0150817 | A1 | 6/2013 | Kainth et al. |
| 2013/0160960 | A1 | 6/2013 | Hermans et al. |
| 2013/0209749 | A1 | 8/2013 | Myangiro et al. |
| 2013/0248129 | A1 | 9/2013 | Manifold et al. |
| 2013/0327487 | A1 | 12/2013 | Espinosa et al. |
| 2014/0004307 | A1 | 1/2014 | Sheehan |
| 2014/0041820 | A1 | 2/2014 | Ramaratnam et al. |
| 2014/0041822 | A1 | 2/2014 | Boechat et al. |
| 2014/0050890 | A1 | 2/2014 | Zwick et al. |
| 2014/0053994 | A1 | 2/2014 | Manifold et al. |
| 2014/0096924 | A1 | 4/2014 | Rekokske et al. |
| 2014/0182798 | A1 | 7/2014 | Polat et al. |
| 2014/0242320 | A1 | 8/2014 | McNeil et al. |
| 2014/0272269 | A1 | 9/2014 | Hansen |
| 2014/0272747 | A1 | 9/2014 | Ciurkot |
| 2014/0284237 | A1 | 9/2014 | Gosset |
| 2014/0360519 | A1 | 12/2014 | George et al. |
| 2015/0059995 | A1 | 3/2015 | Ramaratnam et al. |
| 2015/0102526 | A1 | 4/2015 | Ward et al. |
| 2015/0129145 | A1 | 5/2015 | Chou et al. |
| 2015/0211179 | A1 | 7/2015 | Alias et al. |
| 2015/0241788 | A1 | 8/2015 | Yamaguchi |
| 2015/0330029 | A1 | 11/2015 | Ramaratnam et al. |
| 2016/0060811 | A1 | 3/2016 | Riding et al. |
| 2016/0090692 | A1 | 3/2016 | Eagles et al. |
| 2016/0090693 | A1 | 3/2016 | Eagles et al. |
| 2016/0130762 | A1 | 5/2016 | Ramaratnam et al. |
| 2016/0145810 | A1 | 5/2016 | Miller, IV et al. |
| 2016/0159007 | A1 | 6/2016 | Miller, IV et al. |
| 2016/0160448 | A1 | 6/2016 | Miller, IV et al. |
| 2016/0185041 | A1 | 6/2016 | Topolkaraev et al. |
| 2016/0185050 | A1 | 6/2016 | Topolkaraev et al. |
| 2016/0273168 | A1 | 9/2016 | Ramaratnam et al. |
| 2016/0273169 | A1 | 9/2016 | Ramaratnam et al. |
| 2016/0289897 | A1 | 10/2016 | Ramaratnam et al. |
| 2016/0289898 | A1 | 10/2016 | Ramaratnam et al. |
| 2017/0044717 | A1 | 2/2017 | Quigley |
| 2017/0101741 | A1 | 4/2017 | Sealey et al. |
| 2017/0167082 | A1 | 6/2017 | Ramaratnam et al. |
| 2017/0226698 | A1 | 8/2017 | LeBrun et al. |
| 2017/0233946 | A1 | 8/2017 | Sealey et al. |
| 2017/0253422 | A1 | 9/2017 | Anklam et al. |
| 2017/0268178 | A1 | 9/2017 | Ramaratnam et al. |

FOREIGN PATENT DOCUMENTS

| | | | |
|---|---|---|---|
| CN | 1138356 | A | 12/1996 |
| CN | 1207149 | A | 2/1999 |
| CN | 1244899 | A | 2/2000 |
| CN | 1268559 | A | 10/2000 |
| CN | 1377405 | A | 10/2002 |
| CN | 2728254 | Y | 9/2005 |
| DE | 4242539 | A1 | 8/1993 |
| EP | 0097036 | A2 | 12/1983 |
| EP | 0979895 | A1 | 2/2000 |
| EP | 1911574 | A1 | 1/2007 |
| EP | 1339915 | B1 | 7/2007 |
| EP | 2123826 | A2 | 5/2009 |
| GB | 946093 | A | 1/1964 |
| JP | 2013208298 | A | 10/2013 |
| JP | 2014213138 | A | 11/2014 |
| WO | 96/06223 | A1 | 2/1996 |
| WO | 200382550 | A2 | 10/2003 |
| WO | 200445834 | A1 | 6/2004 |
| WO | 2007070145 | A1 | 6/2007 |
| WO | 2008019702 | A1 | 2/2008 |
| WO | 2009006709 | A1 | 1/2009 |
| WO | 2009/061079 | A1 | 5/2009 |
| WO | 2009067079 | A1 | 5/2009 |
| WO | 2011028823 | A1 | 3/2011 |
| WO | 2012003360 | A2 | 1/2012 |
| WO | 2013024297 | A1 | 2/2013 |

(56) References Cited

FOREIGN PATENT DOCUMENTS

| | | | |
|---|---|---|---|
| WO | 2013136471 | A1 | 9/2013 |
| WO | 2014/022848 | A1 | 2/2014 |
| WO | 201500755 | A1 | 1/2015 |
| WO | 2015/176063 | A1 | 11/2015 |
| WO | 2016/077594 | A1 | 5/2016 |
| WO | 2016/086019 | A1 | 6/2016 |
| WO | 2016/090242 | A1 | 6/2016 |
| WO | 2016/090364 | A1 | 6/2016 |
| WO | 2016085704 | A1 | 6/2016 |
| WO | 2017066465 | A1 | 4/2017 |
| WO | 2017066656 | A1 | 4/2017 |
| WO | 2017139786 | A1 | 8/2017 |

OTHER PUBLICATIONS

Supplementary European Search Report of EP 13 82 6461 dated Apr. 1, 2016.
Written Opinion of International Searching Authority for PCT/US15/62483 dated May 6, 2016.
International Search Report for PCT/US15/63986 dated Mar. 29, 2016.
Written Opinion of International Searching Authority for PCT/US15/63986 dated Mar. 29, 2016.
International Search Report for PCT/US15/64284 dated Feb. 11, 2016.
Written Opinion of International Searching Authority for PCT/US15/64284 dated Feb. 11, 2016.
International Search Report for PCT/US13/53593 dated Dec. 30, 2013.
Written Opinion of International Searching Authority for PCT/US13/53593 dated Dec. 30, 2013.
International Search Report for PCT/US15/31411 dated Aug. 13, 2015.
Written Opinion of International Searching Authority for PCT/US15/31411 dated Aug. 13, 2015.
International Search Report for PCT/US15/60398 dated Jan. 29, 2016.
Written Opinion of International Searching Authority for PCT/US15/60398 dated Jan. 29, 2016.
International Search Report for PCT/US15/62483 dated May 6, 2016.
International Search Report for PCT/US16/56871 dated Jan. 12, 2017.
Written Opinion of International Searching Authority for PCT/US16/56871 dated Jan. 12, 2017.
International Search Report for PCT/US2016/057163 dated Dec. 23, 2016.
Written Opinion of International Searching Authority for PCT/US2016/057163 dated Dec. 23, 2016.
International Search Report for PCT/US2017/029890 dated Jul. 14, 2017.
Written Opinion of International Searching Authority for PCT/US2017/029890 dated Jul. 14, 2017.
International Search Report for PCT/US2017/032746 dated Aug. 7, 2017.
Written Opinion of International Searching Authority for PCT/US2017/032746 dated Aug. 7, 2017.
International Search Report for PCT/US17/17705 dated Jun. 9, 2017.
Written Opinion of International Searching Authority for PCT/US17/17705 dated Jun. 9, 2017.
International Search Report of PCT/US17/51158 dated Nov. 28, 2017.

* cited by examiner

FORMER OF WATER LAID ASSET THAT UTILIZES A STRUCTURED FABRIC AS THE OUTER WIRE

FIELD OF THE INVENTION

The present invention relates to systems and methods for making an absorbent structure utilizing a water laid asset with a structured fabric

BACKGROUND

Across the globe there is great demand for disposable products including towel, sanitary tissue, and facial tissue. Important quality attributes of disposable sanitary tissue and facial tissue include softness and strength, while those of disposable towel include absorbency and strength. The various methods used to produce these products vary in their ability to generate these quality attributes.

Use of a structured fabric can deliver superior levels of bulk that improve absorbency and bulk softness of absorbent structures in disposable products. The higher the bulk and absorbency desired, the higher coarseness structured fabric that needs be utilized. A coarse fabric uses thick monofilament polymeric fibers to create deep valleys in the fabric for cellulosic or synthetic fibers (which compromise the absorbent structure) to penetrate and generate bulk. In structured fabrics made using topically applied and cured resin, an increased resin thickness is needed in order to obtain higher bulk. The downside of using these highly coarse or thick structured fabrics is that the surface smoothness will be negatively impacted. Further, when using TAD, UCTAD, ETAD, or the ATMOS (Twin Wire Configuration) methods (employing a structured fabric) to produce an absorbent structure, the fibers of the absorbent structure penetrate into the structured fabric through the application of vacuum pressure or as an effect of the speed differential between the absorbent structure and the structured fabric. These methods limit the maximum penetration depth and correspondingly, bulk that can be achieved. In an ATMOS process that utilizes a crescent former, the absorbent structure is formed directly between a wire and structured fabric, however, the structured fabric is placed in the inner position (with the structured fabric located between the absorbent structure and the forming roll) rather than the outer position (with the structured fabric located between the absorbent structure and the saveall pan). This means that the drainage of the absorbent structure occurs through the outer wire rather than the structured fabric. The centrifugal force around the forming roll forces water and fiber towards the outer wire limiting the fiber penetration into the structured fabric. Use of vacuum at the wet shaping box helps pull fibers deeper into the fabric, but the total penetration is much less than the void volume available in the fabric. A limitation of the NTT process is that the absorbent structure has to be pressed into the structured fabric which creates compaction that limits absorbency and softness potential.

There is a need in the art for a paper making machine whereby a web is pressed deeply into a structuring fabric in an efficient manner.

SUMMARY OF THE INVENTION

An object of the present invention is to provide a superior method for producing absorbent structures by directly forming and draining a nascent web through a structured fabric. Advantageously, in accordance with exemplary embodiments of the present invention, no fabric crepe, vacuum, or pressing is required to force the web that forms the absorbent structure into the structured fabric. Further, the nascent web is nearly 99.5% water during initial drainage through the structured fabric. This highly viscous nascent web can, therefore, penetrate deeply into the structured fabric using the centrifugal force from the forming roll to allow for high levels of total bulk generation with low coarseness structured fabrics. This preserves the smooth surface of the nascent web while still allowing for high levels of bulk, softness and absorbency.

A method of forming a fibrous web according to an exemplary embodiment of the present invention comprises: providing a fiber slurry; depositing the fiber slurry between an inner forming wire and an outer forming wire, wherein the outer forming wire comprises a structured fabric and the inner forming wire contacts a segment of a forming roll; and rotating the forming roll so that the fiber slurry moves into contact with the structured fabric.

In an exemplary embodiment, the step of depositing is performed by a single layer headbox, a double layer headbox or a triple layer headbox.

In an exemplary embodiment, fiber within the fiber slurry comprise natural fibers, synthetic fibers or a combination of natural and synthetic fibers.

In an exemplary embodiment, the fiber slurry comprises up to 99.95% water.

In an exemplary embodiment, the method further comprises the step of draining the fiber slurry through the structured fabric.

In an exemplary embodiment, the method further comprises: separating the inner forming wire from the outer forming wire; and applying negative pressure from a vacuum box located on an underside of the outer forming wire to adhere a web formed from the fiber slurry to the outer forming wire.

In an exemplary embodiment, the method further comprises the step of dewatering the web by passing the web across one or more vacuum boxes.

In an exemplary embodiment, the method further comprises the step of drying the web, the drying step performed using a belt press having a hot air impingement hood, through air drying cylinders with associated air recirculation systems, or pressure rolls and steam heated cylinders with or without hot air impingement hoods.

In an exemplary embodiment, the method further comprises the step of creping the web from a steam heated cylinder.

In an exemplary embodiment, the method further comprises the steps of calendering and reeling the web.

In an exemplary embodiment, the structured fabric comprises woven monofilaments, the woven monofilaments comprising synthetic polymers.

In an exemplary embodiment, the synthetic polymers comprise polyethylene, polypropylene or nylon.

In an exemplary embodiment, the structured fabric further comprises an overlaid resin.

In an exemplary embodiment, the structured fabric is formed by laying down successive layers of material under computer control.

In an exemplary embodiment, the process of laying down successive layers of material comprises: Fused Deposition Modeling (FDM), PolyJet Technolgy, Selective Laser Melting (SLM), Direct Metal Laser Sintering (DMLS), Selective Laser Sintering (SLS), Stereolithography (SLA), or Laminated Object Manufacturing (LOM)

A wet section of a paper forming machine according to an exemplary embodiment of the present invention comprises: a headbox; a forming roll disposed adjacent to the headbox; an inner forming wire in contact with the forming roll, the inner forming wire configured to run around the forming roll; and an outer forming wire comprising a structured fabric, wherein the headbox is configured to deliver a fiber slurry to an area between the inner forming wire and the outer forming wire.

BRIEF DESCRIPTION OF THE DRAWINGS

The features and advantages of exemplary embodiments of the present invention will be more fully understood with reference to the following, detailed description when taken in conjunction with the accompanying figures, wherein.

DETAILED DESCRIPTION

Figure 1:
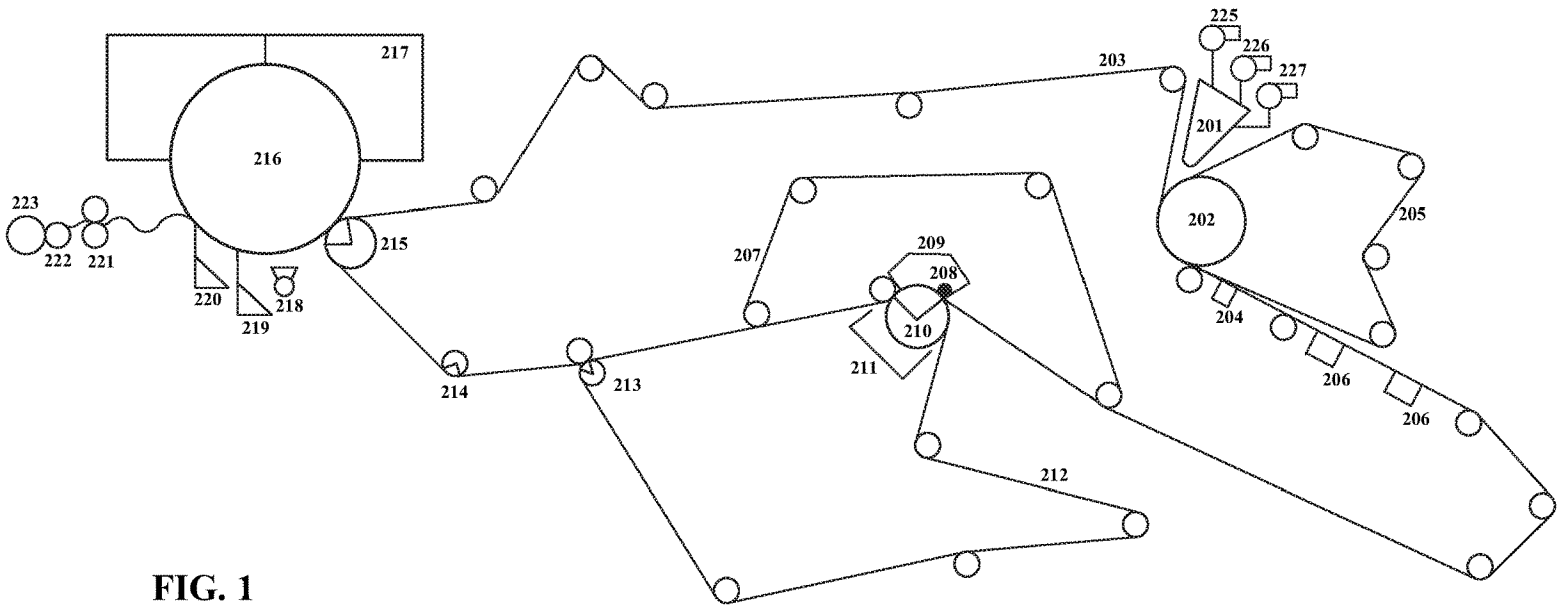
FIG. 1 is a schematic diagram of a paper making machine according to exemplary embodiments of the present invention.

FIG. 1 is a schematic diagram of a paper making machine for manufacturing absorbent structures according to an exemplary embodiment of the present invention. The machine includes one or more pumps, which move dilute slurry to a headbox. For example, FIG. 1 shows a first exterior layer fan pump 225, a core layer fan pump 226, and a second exterior layer fan pump 227. The fan pumps 225, 226, 227 move the dilute slurry of fiber and chemicals to a triple layer headbox 201. It will be understood that headboxes with a different number of layers may be used in embodiments of the invention.

Headbox 201 deposits the slurry into a forming surface comprising a outer structured fabric and an inner forming wire. As shown, in embodiments of the invention, the forming surface is a nip formed by an inner forming wire 205 which runs around forming roll 202, and an outer forming wire 203. In embodiments of the invention, outer forming wire 203 is a woven or polymer overlaid structured fabric ("outer forming wire" and "structured fabric" may be used interchangeably herein below). The slurry is drained through the structured fabric to form a web.

In embodiments of the invention, the slurry contains up to 99.95% water, fibers (either natural, synthetic or a combination of both), chemical polymers, and additives.

In embodiments of the invention, because the outer forming wire 203 is a structured fabric, the centrifugal force created by the rotating forming roll 202 forcefully presses the highly viscous nascent web into the structured fabric of the outer forming wire 203. As a result, the web penetrates deeply into the structured fabric allowing for high levels of total bulk generation with low coarseness structured fabrics.

In embodiments of the invention, the structured fabric is a woven structure that is formed of monofilaments (e.g. yarns, threads) composed of synthetic polymers (preferably polyethylene, polypropylene, or nylon). In embodiments of the invention, the structured fabric is provided with a hardened, cured overlaid resin.

It will be understood that the structured fabric may be manufactured using any of various processes for forming a three-dimensional object, but most preferably through an additive processes in which successive layers of material are laid down under computer control. These processes are generally classified as 3-D printing technologies. For example, these processes include but are not limited to any of the following: Fused Deposition Modeling (FDM), PolyJet Technolgy, Selective Laser Melting (SLM), Direct Metal Laser Sintering (DMLS), Selective Laser Sintering (SLS), Stereolithography (SLA), or Laminated Object Manufacturing (LOM).

In embodiments of the invention, after passing through the forming surface, the inner forming wire 205 separates from the web, and the web is then carried on the structured fabric 203. In embodiments of the invention, a vacuum box 204 is used to assist in web adherence to structured fabric 203. The web is preferably conveyed across one or more dewatering boxes 206 to facilitate dewatering and imprinting the structure of the structured fabric into the web.

After passing the one or more dewatering boxes 206, the web is conveyed on the structured fabric 203 to a belt press. In embodiments of the invention, the belt press is comprised of a permeable belt 207 which contacts the inner (non-web supporting) side of the structured fabric 203 and a permeable dewatering fabric 212, which contacts the web. Preferably, a hot air impingement hood 209 is provided within the belt press that contains a steam shower 208, and a vacuum roll 210. In embodiments of the invention, vacuum roll 210 has through and blind drilled holes in its cover (rubber or polyurethane in different embodiments of the invention). The web is heated by the steam and hot air of the hot air impingement hood 209 to lower the viscosity of the water within the web which is being pressed by the belt press to move the water into the dewatering fabric 212 and into the vacuum roll 210. The vacuum roll 210 holds a significant portion of the water within the through and blind drilled holes in the roll cover until vacuum is broken at the exit of the vacuum box, upon which time the water is deposited into a save-all pan 211. The air flow through the web, provided by the hot air hood 209 and vacuum of the vacuum roll 210, also facilitates water removal as moisture is trapped in the air stream. At this stage, the web properties are influenced by factors such as the structured fabric design and low intensity pressing. The bulk softness of the web is preserved due to the low intensity nip of the belt press which will not compress the web portions within the valleys of the structured fabric 203. The smoothness of the web is influenced by the unique surface topography imprinted by the structured fabric 203 which is dependent on the parameters of weave pattern, mesh, count, weft and warp monofilament diameter, caliper and percentage of the fabric that is knuckle verses valley.

In embodiments of the invention, after exiting the belt press, the web then travels through a second press comprised of a hard roll and soft roll. Press roll 213 located on the inside surface of the dewatering fabric 212 contains a vacuum box to facilitate water removal as the web passes through the nip of the hard and soft rolls. Thereafter, the web is transported by the structured fabric 203 to a wire turning roll 214 (having an optional vacuum box) to a nip between a blind and through drilled polyurethane or rubber covered press roll 215 and steam heated pressure cylinder 216. In embodiments of the invention press roll 215 is a solid polyurethane or rubber roll without vacuum. The web solids are up to 50% solids as the web is transferred to the steam heated cylinder 216. Heated cylinder 216 is preferably coated with chemicals that improve web adhesion to the dryer, improve heat transfer through the web, and assist in web removal at the creping doctor 220. The chemicals are constantly being applied using a sprayboom 218, while excess chemical is removed using a cleaning doctor blade 219. The web is dried by the steam heated cylinder 216 along with an installed hot air impingement hood 217 to a solids content of around 97.5%. The web is removed from the steam heated cylinder 216 using a ceramic doctor blade 220 with a pocket angle of 90 degrees at the creping doctor. At this stage, the web properties are influenced by the creping action occurring at the creping doctor. A larger creping pocket angle will increase the frequency and fineness of the crepe bars imparted to the web's first exterior surface, which improves surface smoothness. In one preferred embodiment of the invention, a ceramic doctor blade is used which allows for a fine crepe bar pattern to be imparted to the web for a long duration of time as compared to a steel or bimetal blade. The creping action imparted at the blade also improves web flexibility, which is improved as the web adherence to the dryer is increased. The creping force is influenced by the chemistry applied to the steam heated cylinder, the percentage of web contact with the cylinder surface which is a result of the knuckle pattern of the structured fabric, and the percent web solids upon creping.

Subsequent to the creping step, the web optionally travels through a set of calenders 221 running, for example, 15% slower than the steam heated cylinder. The action of calendering improves sheet smoothness but results in lower bulk softness by reducing overall web thickness. The amount of calendering can be influenced by the attributes needed in the finished product. For example, a low sheet count, 2-ply, rolled sanitary tissue product will need less calendering than the same roll of 2-ply sanitary product at a higher sheet count and the same roll diameter and firmness. Thus, the thickness of the web may need to be reduced using calendering to allow for more sheets to fit on a roll of sanitary tissue given limitations to roll diameter and firmness. After calendering, the web is reeled using a reel drum 222 into a parent roll 223.

The parent roll 223 can be converted into 1 or 2-ply rolled sanitary or towel products or 1, 2, or 3 ply folded facial tissue products.

Figure 2:
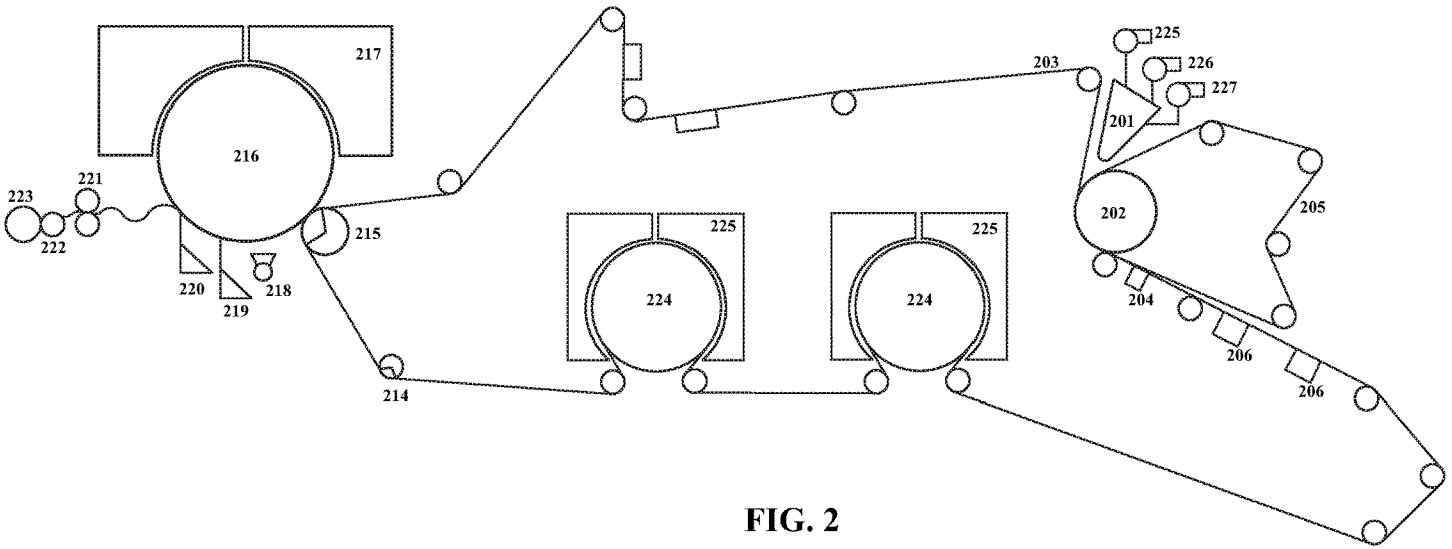
FIG. 2 is a schematic diagram of a paper making machine according to another exemplary embodiment of the present invention.

FIG. 2 shows an alternate drying section of a system for manufacturing absorbent structures according to an exemplary embodiment of the present invention. As shown, rather than traveling through a belt press, the web travels with the structured fabric 203 through two Through Air Dryers ("TADs") before being transferred to the steam heated cylinder 216 for final drying and creping. The airflow from each TAD dryer flows out of the TAD drums 224 into a hood and duct system 225 where the air is reheated using a burner, preferably fired using natural gas, and recirculated back through the TAD drums 224. The airflow and pressure from the TAD drum 224, along with the design of the TAD drum 224, is sufficient to prevent the web from coming into direct contact with the drum surface thereby preventing any defects being incorporated into the web.

In other embodiments of the invention, rather than adhering the web to a steam heated cylinder, the web can be removed from the structured fabric to directly proceed to the calendering section. Any variety of methods can be used to remove the web from the structured fabric. For example, rather than vacuum being supplied to the pressure roll, positive air pressure is used to transfer the sheet from the structured fabric onto a vacuum roll. The vacuum roll contains a vacuum zone and a zone with positive air pressure used to release the sheet from the roll and allow it to proceed through the calenders. A tube threader system may be used to thread the sheet from this vacuum roll through the calenders and reel drum after a web break. A similar system is used to thread after a break from the creping doctor when a steam heated cylinder is utilized.

Having described this invention with regard to specific embodiments, it is to be understood that the description is not meant as a limitation since further modifications and variations may be apparent or may suggest themselves to those skilled in the art. It is intended that the present application cover all such modifications and variations.

What is claimed is:

1. A method of forming a fibrous web, comprising the steps of:

providing a fiber slurry;

depositing the fiber slurry between an inner forming wire and an outer forming wire, wherein the outer forming wire comprises a structured fabric and the inner forming wire contacts a forming roll; and rotating the forming roll so that the fiber slurry moves into contact with the structured fabric.

2. The method of claim 1, wherein the step of depositing is performed by a single layer headbox, a double layer headbox or a triple layer headbox.

3. The method of claim 1, wherein fibers within the fiber slurry comprise natural fibers, synthetic fibers or a combination of natural and synthetic fibers.

4. The method of claim 1, wherein the fiber slurry comprises up to 99.95% water.

5. The method of claim 1, further comprising the step of draining the fiber slurry through the structured fabric.

6. The method of claim 5, further comprising:

separating the inner forming wire from the outer forming wire; and applying negative pressure from a vacuum box located on an underside of the outer forming wire to adhere a web formed from the fiber slurry to the outer forming wire.

7. The method of claim 6, further comprising the step of dewatering the web by passing the web across one or more vacuum boxes.

8. The method of claim 6, further comprising the step of drying the web, the drying step performed using a belt press having a hot air impingement hood, through air drying cylinders with associated air recirculation systems, or pressure rolls and steam heated cylinders with or without hot air impingement hoods.

9. The method of claim 8, further comprising the step of creping the web from a steam heated cylinder.

10. The method of claim 8, further comprising the steps of calendering and reeling the web.

11. The method of claim 1, wherein the structured fabric comprises woven monofilaments, the woven monofilaments comprising synthetic polymers.

12. The method of claim 11, wherein the synthetic polymers comprise polyethylene, polypropylene or nylon.

13. The method of claim 11, wherein the structured fabric further comprises an overlaid resin.

14. The method of claim 1, wherein the structured fabric is formed by laying down successive layers of material under computer control.

15. The method of claim 14, wherein the process of laying down successive layers of material comprises: Fused Deposition Modeling (FDM), PolyJet Technolgy, Selective Laser Melting (SLM), Direct Metal Laser Sintering (DMLS), Selective Laser Sintering (SLS), Stereolithography (SLA), or Laminated Object Manufacturing (LOM).

16. A wet section of a paper forming machine, comprising:

a headbox;

a forming roll disposed adjacent to the headbox;

an inner forming wire in contact with the forming roll; and an outer forming wire comprising a structured fabric;

wherein the headbox is configured to deliver a fiber slurry to a nip formed between the inner forming wire and the outer forming wire as the forming roll rotates.

17. The wet section of claim 16, wherein the headbox is a single layer headbox, a double layer headbox or a triple layer headbox.

* * * * *